United States Patent [19]

Bregatta

[11] Patent Number: 4,521,921

[45] Date of Patent: Jun. 11, 1985

[54] EXPANDABLE CHEST PIECE AND METHOD OF CONSTRUCTING A GARMENT USING SAME

[75] Inventor: Ray J. Bregatta, Cherry Hill, N.J.

[73] Assignee: Pellon Corporation, New York, N.Y.

[21] Appl. No.: 416,748

[22] Filed: Sep. 10, 1982

[51] Int. Cl.[3] ..... A41D 1/02; A41D 27/02

[52] U.S. Cl. ..... 2/93; 2/97; 2/272

[58] Field of Search ..... 2/93, 97, 243 R, 243 A, 2/243 B, 266, 272

[56] References Cited

U.S. PATENT DOCUMENTS

| | | | |
|---|---|---|---|
| 1,683,226 | 9/1928 | Zuck | 2/272 |
| 2,240,448 | 4/1941 | Goldstein | 2/97 |
| 2,275,090 | 3/1942 | Reiss et al. | 2/97 |
| 2,923,945 | 2/1960 | Verlengia | 2/97 |
| 3,130,417 | 4/1964 | Abalman | 2/97 |
| 3,585,645 | 6/1971 | Moriwaki | 2/272 |
| 3,812,540 | 5/1974 | Pagano | 2/93 |
| 3,829,901 | 8/1974 | Massetti et al. | 2/97 |

*Primary Examiner*—H. Hampton Hunter
*Attorney, Agent, or Firm*—Sprung Horn Kramer & Woods

[57] ABSTRACT

An expandable chest piece and a method of constructing a garment wherein the chest piece is connected to the garment fabric between the arm hole and the lapel break line. The chest piece is prefabricated by providing a carrier member composed of relatively stiff textile material and configured to have a first connecting edge in the vicinity of the lapel break line and a second connecting edge in the vicinity of the arm hole of the garment and connecting an elongated connecting strip composed of relatively stiff textile material and configured to extend substantially the entire length of the first connecting edge to the carrier member for movement from a rest position wherein the connecting strip overlaps the first edge with the outer edge of the strip spaced therefrom and substantially parallel thereto to an extended position wherein the outer edge is spaced further from the first edge. The chest piece is positioned on the fabric with the second edge aligned with the arm hole. The outer edge of the connecting strip is aligned with the lapel break line and is connected to the fabric without changing the position of the carrier member by moving the connecting strip from the rest position if necessary and the second edge is connected to the fabric.

12 Claims, 3 Drawing Figures

EXPANDABLE CHEST PIECE AND METHOD OF CONSTRUCTING A GARMENT USING SAME

BACKGROUND OF THE INVENTION

The present invention relates to a chest piece for a garment such as a suit jacket or blazer and to a method for constructing such a garment.

In the conventional manufacture of sport coats and the like, the chest piece which is utilized in the construction thereof is generally prefabricated from a one piece chest "canvas" or carrier which has a first connecting edge which is connected to the lapel break line by means of a bridle tape and the second connecting edge in the vicinity of the arm hole which is connected thereto at some later point in the manufacture of the jacket. The chest piece may also comprise, in dependence on the quality of the garment to be made, a shoulder piece at the top portion of the chest carrier and chest felt overlying the chest carrier and shoulder piece and against which the jacket lining is eventually disposed.

While jackets have been made for many years utilizing the one piece chest carrier, a typical problem that results therefrom is the fact that after the garment is constructed and is dry-cleaned several times, the chest carrier tends to shrink at a different rate than the garment outer fabric with the result that in the upper chest area the material has "length", that is, the garment fabric begins to pucker or buckle.

Another disadvantage of the one piece chest carrier is the degree of skill needed by the operator to initially construct the garment without the presence of "length" even when the garment is new. In view of the three dimensional shape that the garment must take on when finally constructed, the slightest inaccuracies in the connecting of the chest carrier along its two connecting edges during the construction of the garment, will result in this puckering.

SUMMARY OF THE INVENTION

The object of the present invention is to eliminate the disadvantages of the prior art chest pieces and to provide an improved chest piece which will eliminate the undesirable puckering in the garment due to shrinkage and to eliminate the skill needed by the operator constructing the garment to avoid the presence of the puckering when initially constructed.

Another object of the present invention is to provide an improved method of constructing a garment utilizing an expandable chest piece which reduces the skill of the operator in connecting the chest piece to the garment fabric.

These and other objects of the present invention are achieved in accordance with the present invention by a carrier member composed of relatively stiff textile material and configured to have a first connecting edge in the vicinity of the lapel break line and a second connecting edge in the vicinity of the arm hole of the garment, an elongated connecting strip composed of relatively stiff textile material and configured to extend substantially the entire length of the first connecting edge and means, composed of relatively flexible textile material, connecting the strip to the carrier member for movement from a rest position wherein a connecting strip overlaps the first edge with the outer edge of the strip spaced therefrom and substantially parallel thereto to an extended position wherein the outer edge is spaced further from the first edge.

The connecting means preferably comprises a bellows connection created by a bellows strip of relatively flexible textile material connected at one longitudinal edge to the first edge and at the opposite edge to the inner edge of the connecting strip.

The expandable chest piece may further comprise a traditional shoulder piece member of textile material and optionally thereabove a chest felt member. The chest piece may also comprise a strip of bridle tape connected to the outer edge of the connecting strip and overlapping same for effecting connection of the connecting strip to the lapel break line of the garment.

In a method according to the present invention, the above-referenced chest piece is prefabricated and is thereafter positioned on the garment fabric with the second edge aligned with the arm hole. The outer edge of the connecting strip is thereafter aligned with the lapel break line and connected to same without having to change the position of the carrier member and thus the alignment with the arm hole. This is made possible by the fact that the connecting strip can be moved from the rest position if necessary. Thereafter, the second edge is connected to the fabric.

The connecting strip and carrier member are preferably formed from the same material, preferably nonwoven material having relative stiffness and springiness which is desirable in a chest piece for a garment.

These and other advantages and features of the present invention will become apparent from the following detailed description in conjunction with the drawings, wherein:

DETAILED DESCRIPTION OF THE INVENTION

Figure 1:
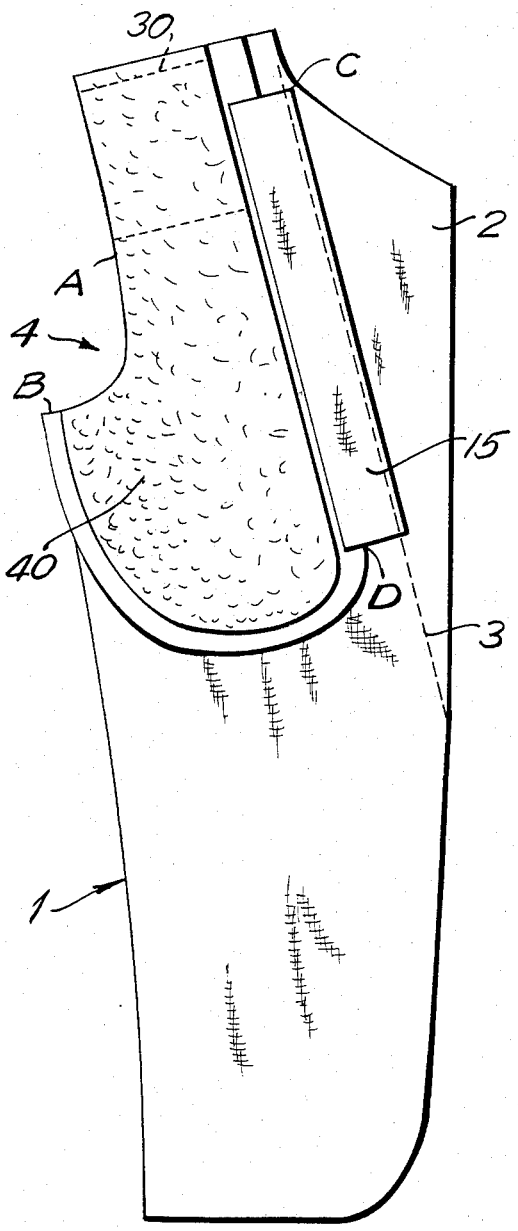
FIG. 1 is a top view of a prefabricated chest piece according to the present invention when placed on the garment fabric.
Figure 2:
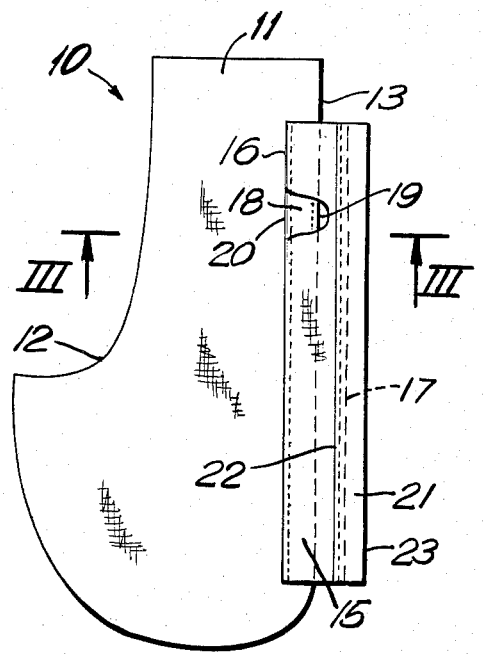
FIG. 2 is a top view of an expandable chest piece according to the present invention.

In FIGS. 1 and 2, a pre-cut fabric section 1 for one side of a suit jacket comprises the garment fabric with the already fused in interlining thereon, produced conventionally in the manufacture of sport coats and the like. The fabric section 1 includes a lapel 2 which is predetermined to fold around a lapel break line 3 and also includes an arm hole 4 which will be later attached to a sleeve during the construction of the garment.

As is conventional in the manufacture of garments of this type, the chest piece is prefabricated and placed in position on the fabric section 1 by an operator so that process of connecting it in place may begin.

The chest piece 10 comprises the chest canvas or carrier member 11 which is configured to have a first connecting edge 13 which extends from points C to D in FIG. 1 and second connecting edge 12 which extends from points A to B.

Connected to the edge 13 of member 11 is a connecting strip 15 which has an inner edge 16 and an outer edge 17. The strip 15 is connected in a bellows-like construction with a bellows connecting strip 18 which has one edge 19 connected to the edge 13 and another edge 20 connected to the inner edge 16. The strip 15 is connected so as to overlap the connecting edge 13 as shown.

Figure 3:
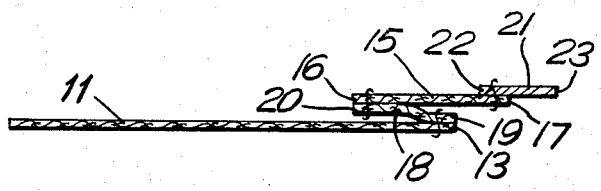
FIG. 3 is a sectional view along line III—III of FIG. 2.

In a particularly advantageous commercial embodiment, the connecting strip 15 is one inch wide and is preferably constructed from the same material as the chest carrier member 11. Members 11 and 15 are preferably composed of a non-woven material, for example Pel-Shape 8003, however it can also be made from other non-wovens and woven textiles have the requisite stiffness and springiness that is desirable for a chest piece. The bellows strip 18 is preferably relatively flexible and may be conveniently made from rayon woven lining material. The bellows strip 18 may be connected in place, as shown in FIG. 3 by conventional machine stitching.

The connecting strip 15 thus has its outer edge ready for connecting in place at the lapel break line 3. A conventional method by which this is done, is by use of a bridle tape 21 which is either stitched onto the connecting piece 15 at the outer edge 17 thereof along edge 22 of bridal tape 21, or else it can be fused thereon. The other edge 23 of the bridle tape 21 can then be stitched or fused onto the lapel break line 3 in a conventional manner.

According to the method of constructing a garment according to the present invention, the prefabricated expandable chest piece 10 is provided as shown in FIG. 2, although it may have the optional shoulder piece 30 and chest felt 40 mounted thereon, depending upon the quality of the garment to be made. The prefabricated chest piece 10 is placed on the fabric section 1 with the edge 12 thereof aligned with the arm hole 4 in the conventional manner.

The particular advantage of the present invention is that with the chest piece now in place, the connecting piece 15 can be aligned with the lapel break line 3 without having to move the carrier member 11 or change the alignment of edge 12 with the arm hole 4. This results from the fact that in accordance with the bellows construction shown in FIG. 3, the connecting strip 15 can move to the right thus disposing edge 17 further from edge 13.

Another advantage of the construction according to the present invention, is that because the difference from the arm hole to the break line for three sizes is approximately ¼" per size, an expandable chest piece according to the present invention can be used for constructing jackets of three sizes, i.e. 34 to 36 or 38 to 40, without the need for providing three different size chest pieces. Thus inventories can be reduced due to the flexibility of the expandable chest piece according to the present invention.

After the bridle tape 21 is aligned along the lapel break line, it is either stitched or fused in place in a conventional manner. Normally the alignment takes place with respect to markings on the fused interlining on the garment fabric or by other marking techniques.

Thereafter, in accordance with conventional techniques, the chest piece is connected along the arm hole edge 12 in a manner to give the jacket a three-dimensional shape.

It can be seen that if shrinkage of the chest piece occurs after subsequent dry cleaning, the appearance of "length" in the front fabric at the shoulder of jacket will not occur due to the fact that it will be eliminated by the expansion of the chest piece which will permit connecting strip 15 to move relative to carrier member 11.

It should also be clear that during the securing of the arm hole connecting edge of the chest piece to the sleeve, if inaccuracies are present from the initial connection of the connecting piece 15 to the lapel break line, that these can be compensated for by re-aligning the arm hole edge with the avoidance of the appearance of "length" since the chest piece will expand due to the bellows construction.

It should also be understood that other kinds of bellows connections can be made in order to connect the connecting strip to the carrier member in order to achieve expansion. For example, the two members can be stitched together with a loose stitching which will enable the expansion. Moreover, the two members can be connected at discrete portions thereof by individual pieces of fabric to effect a hinging expansion.

It will be appreciated that the instant specification and examples are set forth by way of illustration and not limitation, and that various modifications and changes may be made without departing from the spirit and scope of the present invention.

What is claimed is:

1. An expandable chest piece for a garment comprising:

a carrier member composed of relatively stiff textile material and configured to have a first connecting edge in the vicinity of the lapel break line and a second connecting edge in the vicinity of the arm hole of a garment;

an elongated connecting strip composed of relatively stiff textile material and configured to extend substantially the entire length of the first connecting edge; and means, composed of relatively flexible textile material, connecting the strip to the carrier member for movement from a rest position wherein the connecting strip overlaps the first edge with the outer edge of the strip spaced therefrom and substantially parallel thereto to an extended position wherein the outer edge is spaced further from the first edge.

2. The expanded chest piece according to claim 1, wherein the connecting means comprises a bellows connection including bellows strip of relatively flexible textile material connected at one longitudinal edge to the first edge and at the opposite edge to the inner edge of the connecting strip.

3. The expandable chest piece according to claim 1, further comprising a shoulder piece member of textile material connected at the top portion of the carrier member between the connecting edges.

4. The expandable chest piece according to claim 1 or 3, further comprising a chest felt member configured to overlie the carrier member and connected thereto.

5. The expandable chest piece according to claim 1, further comprising a strip of bridle tape connected along the outer edge of the connecting strip and overlapping same.

6. The expandable chest piece according to claim 2, wherein the carrier member and connecting strip comprise non-woven textile material and the bellows strip comprises woven lining material.

7. In a method of constructing a garment wherein a chest piece is connected to the garment fabric between the arm hole and the lapel break line, the improvement comprising the steps of:

a. prefabricating the chest piece by providing a carrier member composed of relatively stiff textile material and configured to have a first connecting edge in the vicinity of the lapel break line and a second connecting edge in the vicinity of the arm hole of the garment and connecting an elongated connecting strip composed of relatively stiff textile material and configured to extend substantially the entire length of the first connecting edge to the carrier member for movement from a rest position wherein the connecting strip overlaps the first edge with the outer edge of the strip spaced therefrom and substantially parallel thereto to an extended position wherein the outer edge is spaced further from the first edge;

b. positioning the chest piece on the fabric with the second edge aligned with the arm hole;

c. aligning the outer edge of the connecting strip with the lapel break line and connecting same to the fabric, without changing the position of the carrier member, by moving the connecting strip from the rest position, if necessary; and d. connecting the second edge to the fabric.

8. The method according to claim 7, wherein the step of connecting the connecting piece to the carrier member comprises providing a bellows strip of relatively flexible textile material, connecting one longitudinal edge of the bellows strip to the first edge and connecting the opposite edge of the bellows strip to the inner edge of the connecting strip.

9. The method according to claim 7, wherein the step of prefabricating further comprises connecting a shoulder piece member to the top portion of the carrier member.

10. The method according to claims 7 or 9, wherein the step of prefabricating further comprises connecting a chest felt member on the carrier members.

11. The method according to claim 7, wherein the step of connecting the outer edge of the connecting strip comprises connecting an overlapping strip of bridle tape to the outer edge and connecting the free edge to the bridle tape to the fabric.

12. The method according to claim 8, wherein the carrier member and connecting strip are formed from non-woven textile material and the bellows strip is formed from woven lining material.

* * * * *